US005474186A

United States Patent [19]

Fulghum, Jr. et al.

[11] Patent Number: 5,474,186

[45] Date of Patent: Dec. 12, 1995

[54] CYLINDRICAL CLASSIFIER

[75] Inventors: Oscar T. Fulghum, Jr.; George H. Fulghum, Sr., both of Wadley, Ga.

[73] Assignee: Fulghum Industries, Inc., Wadley, Ga.

[21] Appl. No.: 319,362

[22] Filed: Oct. 6, 1994

Related U.S. Application Data

[63] Continuation of Ser. No. 55,311, May 3, 1993, abandoned.

[51] Int. Cl.[6] ..... B07B 1/22

[52] U.S. Cl. ..... 209/291; 209/290

[58] Field of Search ..... 209/291, 290, 209/289, 288, 284

[56] References Cited

U.S. PATENT DOCUMENTS

| | | | |
|---|---|---|---|
| 320,326 | 6/1985 | Barnhart | 209/291 X |
| 361,413 | 4/1887 | Hendershot | 209/291 X |
| 513,973 | 2/1894 | Aulmann | 209/291 |
| 528,969 | 11/1894 | Phillips | 209/291 X |
| 883,974 | 4/1908 | Roughsedge | 209/291 |
| 1,677,862 | 7/1928 | Herrold | 209/288 |
| 2,711,250 | 6/1955 | Clark | 209/291 |
| 3,528,124 | 9/1970 | Wenstrom . | |
| 3,662,432 | 5/1972 | Wenstrom . | |
| 3,665,554 | 5/1972 | Wenstrom . | |
| 4,078,995 | 3/1978 | Litt | 209/288 X |
| 4,675,946 | 6/1987 | Bunge . | |

*Primary Examiner*—David H. Rollinger
*Attorney, Agent, or Firm*—Cushman, Darby & Cushman

[57] ABSTRACT

A cylindrical classifier includes a first rotating cylinder having a surface composed of parallel separator rods or tubes that extend along the length of the cylinder. The tubes or rods are spaced from each other to prevent oversized objects from passing between them. Material to be classified is fed to the interior of the cylinder. As the cylinder rotates, objects of the desired size and smaller objects pass between the spaced separator rods and exit the cylinder. The first cylinder is surrounded by a second coaxial cylinder so that there is a space between the first and second cylinders. The outer cylinder has a separating screen which prevents objects of a desired size from passing through. The coaxial cylinders rotate about an axis that is slightly inclined relative to the horizontal so that as the cylinders rotate, oversized pieces are discharged at a lower end from the interior of the inner cylinder, desired sized pieces are discharged at the lower end from the interior of the outer cylinder, and undersized pieces are discharged through the screen of the outer cylinder.

24 Claims, 3 Drawing Sheets

CYLINDRICAL CLASSIFIER

This is a continuation of application Ser. No. 08/055,311, filed on May 3, 1993, now abandoned.

BACKGROUND OF THE INVENTION

1. Field of the Invention

The present invention relates to an apparatus for classifying solids and more particularly to a cylindrical classifier for classifying chipped wood by size.

2. Description of the Related Art

Classifying machines are frequently used to separate specific sizes of solids from other sizes in processing systems. For example, classifiers are commonly used to classify crushed stone in stone crushing processes or to classify wood chips in wood chip processing systems.

A common wood chipping system includes a wood chipper, for example, of the type exemplified by U.S. Pat. No. 3,069,101 to Wexell. The wood chipper chips large logs, timber, branches and other wood scraps into smaller chips. The chips are exhausted by the chipper onto a conveyor or into a receptacle. The chips thus formed are typically used for making paper. Paper production requires that the wood chips be converted into pulp by chemical digestion. The rate of chemical digestion of a wood chip is directly related to the thickness of the chip. The width and length of the chips is relatively unimportant because the diffusion of chemicals into the wood is most important in the direction of the thickness of the chip. Thus, there is an ideal range of thickness for chips for paper making. However, chips produced by wood chippers are not all uniform in size and shape. Indeed, due to the nature of the chipping process and the diverse physical characteristics of the wood, the chips produced may be quite diverse in size, shape and thickness. The output of a conventional chipper includes oversized chips and also undersized particles, such as fines and pins. The oversize chips are not properly digested by the chemicals because of their great size. The undersize pins and fines also are disadvantageous to the process.

Therefore, to maintain proper quality control and optimum consistency for further processing, the chips exhausted from the chipper must be classified by size to separate the acceptably sized chips (accepts) from the oversized material (overs) and undersized material (fines).

Conventional classifiers use screens of various aperture size. In some such classifiers, the screens are stacked with the largest on the top and the most fine on the bottom. Such a classifier will separate solids on the basis of size, leaving the overs on the top screen while allowing fines to fall to successively smaller screens, leaving only the smallest parts to fall through the lowest and finest screen. A vibration mechanism is typically provided to encourage the movement of the material being classified through the screens.

Other classifiers are in the form of cylindrical screens which are inclined and rotate to encourage movement of the material and complete classification during residency in the classifier. Known cylindrical classifiers are provided for the separation of fines, with overs being previously or subsequently separated from the accepts.

Screen-type classifiers classify solids on the basis of overall size. Thus, such classifiers will not be able to classify objects on the basis of one dimension alone. For example, screen type classifier will not be able to classify wood chips on the basis of thickness, regardless of the width or length.

SUMMARY OF THE INVENTION

It is an object of the present invention to provide a classifier for separating accepts from overs on the basis of thickness. More particularly, it is an object of the invention to provide a classifier to separate overs and fines from accepts for further processing.

The classifier of the present invention is a cylindrical classifier having two concentric cylindrical separator layers or classifiers. The two layers rotate about a common, slightly inclined axis. The axis is inclined so that material will slowly travel therealong. Material to be classified is in-fed to the interior of the innermost cylinder of the classifier at the highest end of the classifier, via conveyor or in-feed chute. As the cylinders rotate, accepts and fines pass from the inner cylinder into a more radially outer section while the overs remain within the inner cylinder. The fines pass through the second cylindrical layer and are discharged while the accepts remain between the first and second cylindrical layers and are discharged at the lower end of the classifier. In accordance with the invention, the inner cylinder is defined by a plurality of circumferentially spaced, longitudinally extending rods whereby the accepts are separated from the overs by thickness. The outer layer may be a screen-type fines separator.

Other objects, features, and characteristics of the present invention, as well as the methods of operation and functions of the related elements of structure, and the combination of parts and economics of manufacture, will become more apparent upon consideration of the following description and the appended claims with reference to the accompanying drawings, all of which form a part of this specification, wherein the reference numerals designate corresponding parts in the various figures.

DETAILED DESCRIPTION OF THE PRESENTLY PREFERRED EXEMPLARY EMBODIMENTS

Figure 1:
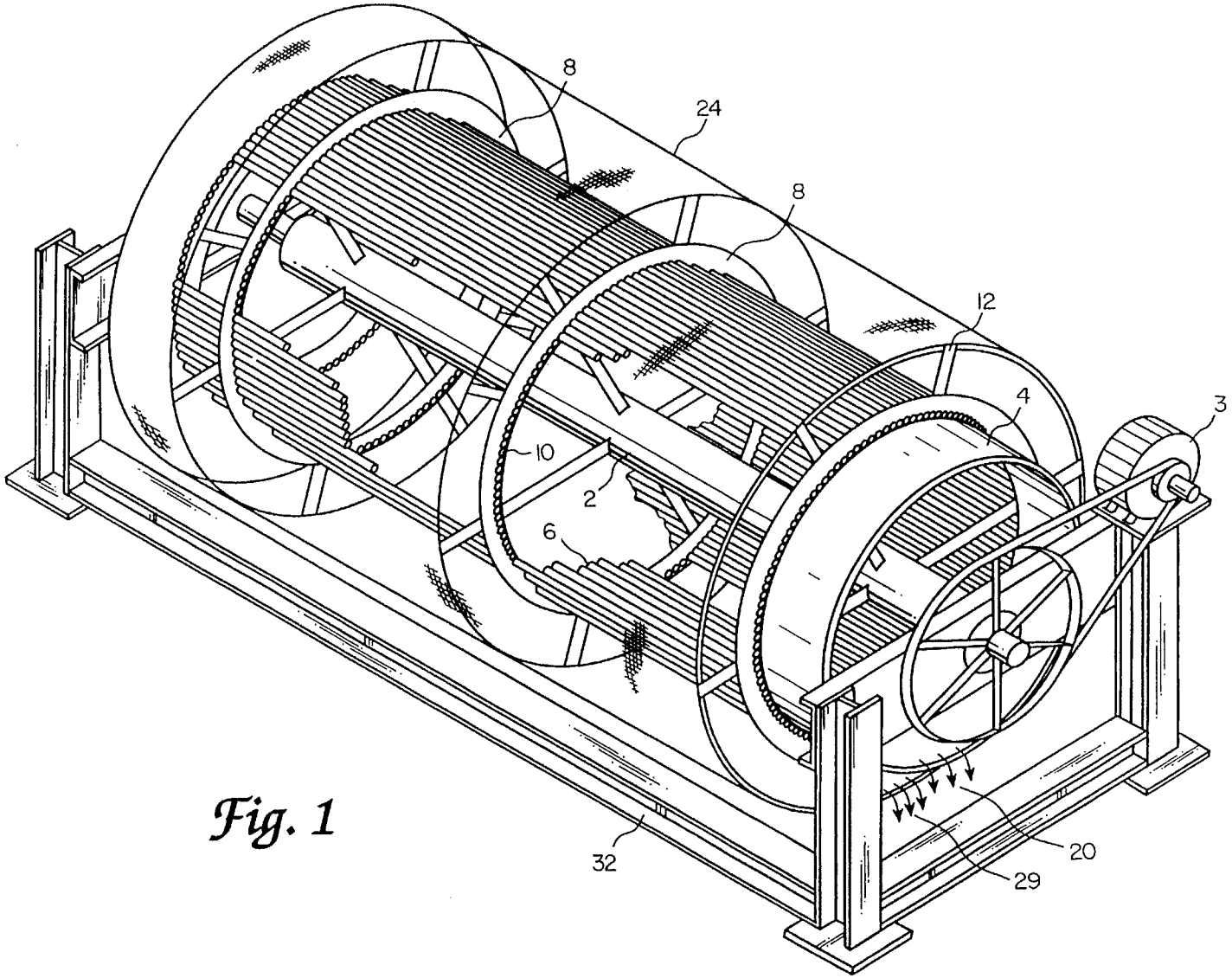
FIG. 1 is a perspective view of the classifier of the present invention.
Figure 2:
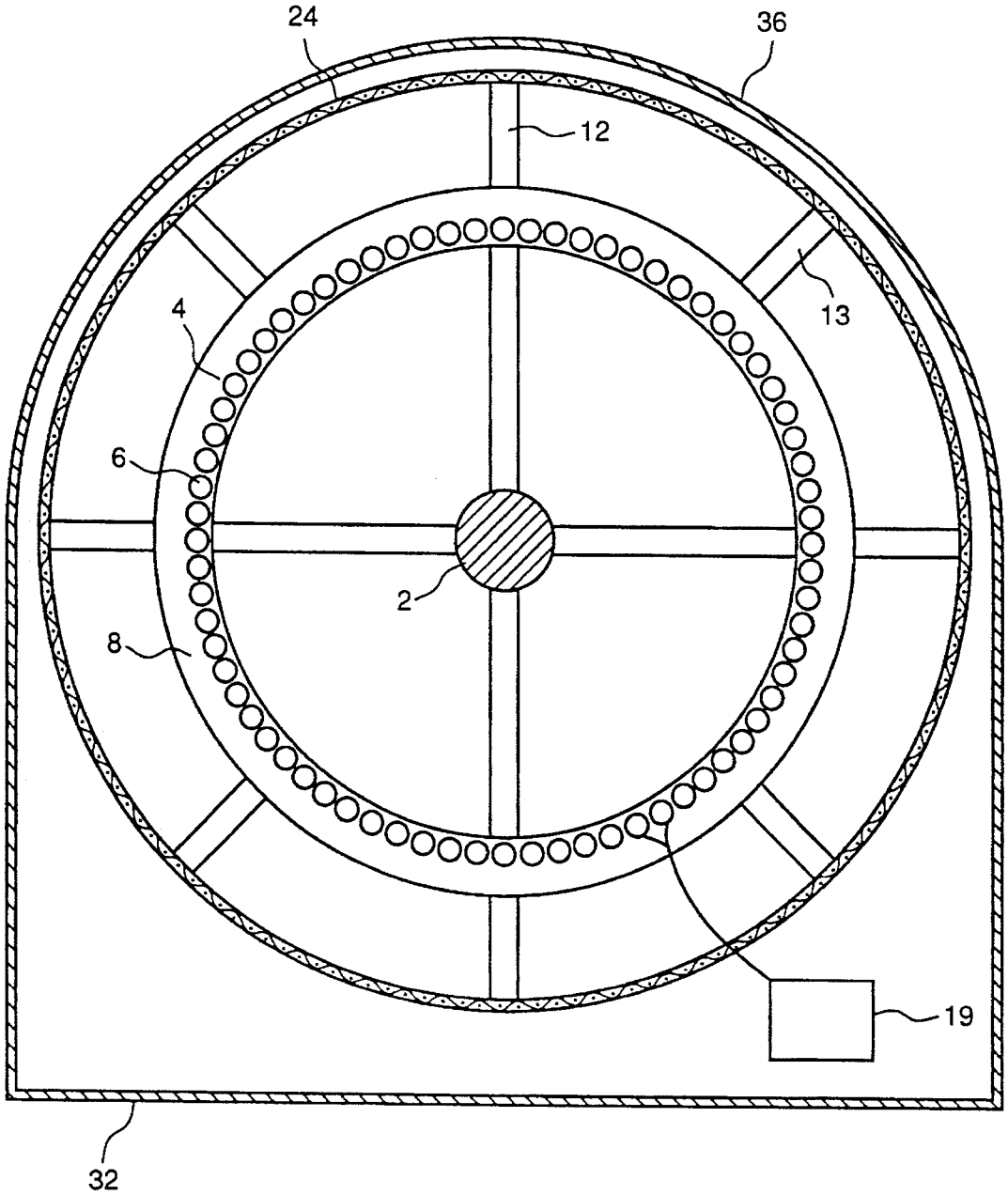
FIG. 2 is a transverse cross-section of the cylindrical classifier of FIG. 1.

The classifier, as shown in FIGS. 1 and 2, has two concentric cylinders which rotate about a slightly inclined axle 2. The wall of the inner cylinder 4 is defined by a plurality of longitudinally extending separator members 6 or rods which are circumferentially spaced apart but parallel to each other and also parallel to the axle 2 of the cylinder. The members can extend the length of the cylinder. In that event, it may be desirable to provide frame or support rings 8 at spaced locations along the length of the cylinder, to ensure that a desired member spacing is maintained. Such frame rings may be attached to the rods or the rods may be inserted through suitable apertures 10 defined therethrough. As an alternative, the rods can each extend along only a portion of the length of the cylinder, between frame rings. As yet a further alternative, a combination of short and long rods can be provided as deemed necessary or desirable.

The frame support rings 8 are placed one at each end of the cylinder. One or more intermediate rings may be placed between the end rings depending upon the length of the classifier. Most preferably, the support rings are provided every 1 to 2 meters along the length of the classifier. In the illustrated embodiment, each support ring is connected to an axle of the classifier by a plurality of spokes 12. In FIGS. 1 and 2, four spokes 12 are shown, but more or fewer spokes 12 may be used depending upon the diameter of the classifier.

The spacing of the support rings 8 depends upon a number of factors. As objects are placed inside the inner cylinder to be classified, large objects can become pressed between two adjacent separating members. The weight of overlaying material can pry open the gap between two separator members, thus allowing oversized chips to pass through the inner cylinder 4. Thus, depending upon the rigidity of the separator members 6 and the type of chips to be processed, the support rings 8 must be spaced closer together to prevent distortion of the gap.

The diameter of the separator members 6 is preferably in the range of about 15 to 50 mm, although they may be larger or smaller depending upon the particular application, the size of the separator, and the size of the objects to be classified. Chips of the optimum thickness need not have specifically limited width or length dimensions because the gaps between the separator members are continuous along the length of the cylinder, between the support rings 8. For example, a cylindrical classifier 10 meters long may have two end support rings and two spaced intermediate support rings. The length of the gap between the separator members is thus about 3 to 4 feet.

The separator members 6 or rods may be solid or hollow and may be made of plastic (PVC) or metal. Also, the separator members may be round or square and may be fixed to the support rings 8, or they may rotate relative to the support rings. The surface of the separator members are smooth, but alternatively, they may have a knurled or textured surface which may have advantages if the members rotate relative to the support rings 8.

The members 6 are spaced apart a distance which permits chips of less than or equal to the optimum thickness to pass between adjacent rods. The space between the separator members depends upon the thickness of the chips that are desired to be passed through. For example, a classifier for separating chips for pulp processing has a gap of approximately 6 to 10 mm between the separator members.

Figure 3:
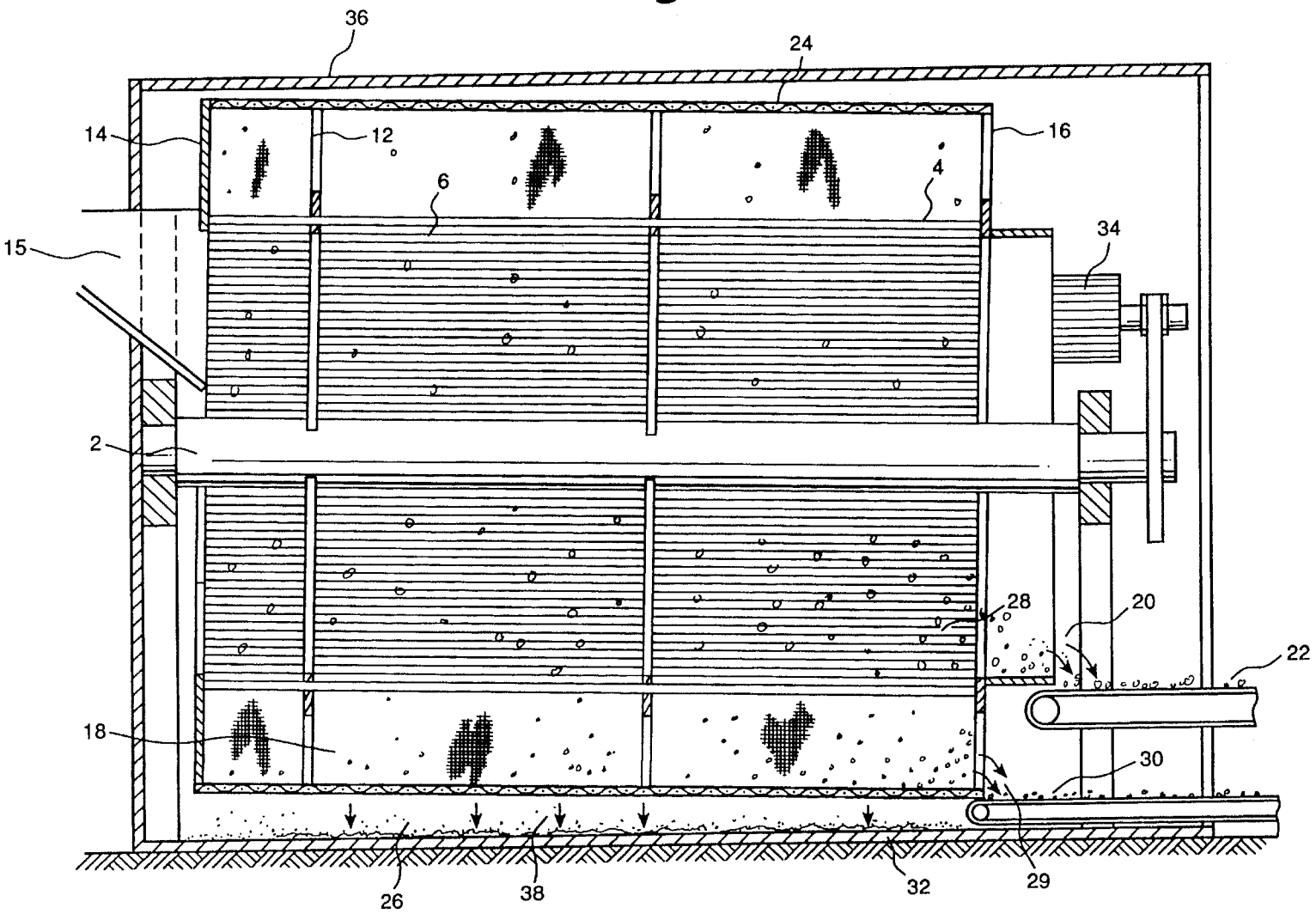
FIG. 3 is a longitudinal cross-section of the cylindrical classifier of FIG. 1.

During operation, chips are continuously dumped into the interior of the inner cylinder at the high end 14 of the classifier via an infeed chute 15, as shown in FIG. 3. As the cylinders rotate, the chips tumble about in the inner cylinder 4 and slowly move towards the lower end 16 of the cylinder. All chips having a thickness less than the distance between the separator members pass between parallel separator members 6 and into the space between the cylinders. All oversize chips continue to tumble Within the inner cylinder 4 and eventually move down along the classifier and fall out 20 at the lower end of the inner cylinder. The oversize chips discharged at the end fall onto a conveyor 22 or other collection means and are carried away from the classifier.

The outer cylinder 24 surrounds and is uniformally spaced from the inner cylinder 4 and has a cylinder wall preferably made of a separating material of a size sufficient to allow pins and fines to pass therethrough. Preferably the separating material is round hole punch plate. Alternatively, the outer cylinder 24 may have a wall made of separator members similar to those of the inner cylinder 4, but having a narrower gap between the members.

The chips that pass through the wall of the inner cylinder enter the space 18 between the inner and outer cylinder. The outer cylinder is supported coaxially with the inner cylinder by a plurality of spokes 12 which emanate from the axle 2 and pass through the inner cylinder 4. The spokes supporting the outer cylinder can be continuations of the spokes that support the inner cylinder. Additionally, or alternatively, radial supports 13 may also extend solely from the support rings of the inner cylinder to the outer cylinder.

The wall of the outer cylinder 24 is a screen or other separating means having a porosity slightly smaller than the minimum acceptable size of the chips. Therefore, the correctly sized chips or accepts will remain within the second cylinder while the undersized particles 26 fall through the screen in the outer cylinder to exit the classifier. The undersized particles may fall onto a conveyor or other collecting means and are carried away from the classifier.

The accepts 28 remain within the outer cylinder and tumble towards the lower end as the cylinder rotates. The acceptable chips fall out 29 of the lower end and are collected on a conveyor 30 or other collecting means known in the art.

The cylindrical classifier is supported by a base 32 and connected to a motor 34 which slowly rotates the cylinders, for example, by rotating the axle which supports the cylinders. The classifier may also be covered by a housing 36 which protects the system from rain and wind. A plurality of conveyor or other collection means 22, 30 are located at the lower end 16 of the classifier to remove the chips which are discharged from the inner 4 or outer 24 cylinder. The undersized chips, pins and fines which fall out 38 of the classifier can be removed as necessary.

The nature of the chips and volume of chips processed by the cylindrical classifier may occasionally result in oversize chips becoming wedged between separator members. The wedged chips may expand the gap between the members thus possibly permitting other overs to pass therethrough. The wedged chips may clog a portion of the inner cylinder preventing even small chips to pass. A number of alternatives are available to reduce the occurrence of jammed chips.

As noted above, the separator members 6 may be supported by the support rings 8 such that each separator member 6 is individually freely rotatable relative to the support rings 8. Thus, when a chip becomes partially wedged, the separator members can freely rotate to allow the chip to completely pass between them or reenter the overs flow. To be sure the rotating separator members 6 don't allow large chips to pass through, the rotating rods may desirably be mounted slightly closer together so that only the proper sized chips are passed through.

Alternatively, the separator members may be rotatable by a motor 19 such that when the classifier is in operation, the separator members are constantly rotating. The motor may be the same motor that rotates the cylinders. As yet another alternative, rather than having the separator members 6 rotated by a motor, the members can be supported in a freely rotatable manner and are weighted such that each member has a preferred orientation relative to the horizon. When the classifier is rotated, gravitational force causes the members to constantly rotate to maintain their orientation relative to the horizon.

The cylindrical classifier described above has two coaxial cylinders 4, 24 which are slightly inclined to the horizontal and are rotated for separating parts of in-fed materials by size. The inner cylinder 4 has a wall of spaced parallel members 6 having a narrow gap between them which allows fines and accepts to pass. Overs remain within the inner cylinder. The parts that pass through the inner cylinder fall into a space 18 between the inner cylinder 4 and the outer cylinder 24. The outer cylinder 24 is preferably a screen which allows the fines to pass through, but retains the accepts.

Of course, a cylindrical classifier as described above may have more or fewer cylinders for performing more or fewer classifications. For example, the classifier may have more than one cylinder with parallel separator members, or more than one cylinder with separator screens. Additionally, the cylinders of the classifier may be rotated together or counter rotated. The angle of inclination is preferably about 5°, but can be as great as about 15°, or as little as about 1° depending upon the length of the classifier and the speed at which material is designed to flow through the classifier.

While the invention has been described in connection with what is presently considered to be the most practical and preferred embodiment, it is to be understood that the invention is not to be limited to the disclosed embodiment but, on the contrary, is intended to cover various modifications and equivalent arrangements included within the spirit and scope of the appended claims.

What is claimed is:

1. A cylindrical classifier for classifying objects by thickness comprising:

a first cylinder defined by a plurality of parallel separator members extending in a longitudinal direction from a first end of the cylinder to a second end of the cylinder, the parallel separator members being spaced apart so as to define gaps therebetween, a width of the gaps defining a separating parameter of the classifier; and at least two support rings, a first ring disposed near the first end of the cylinder, and a second ring disposed near the second end of the cylinder, the support rings being connected at a center thereof to an axle about which the rings are concentrically rotatable, the separator members being supported at each end of the cylinder by the support rings, whereby objects having a variety of thicknesses are infed to an interior of the first cylinder and are separated as objects having a thickness dimension less than the width of the gaps pass through the gaps and exit the cylinder while objects having a thickness greater than the width of the gaps do not pass through the gaps wherein each support ring has a plurality of holes or separator member support elements for supporting each separator member, and wherein the separator members are freely rotatable relative to the support ring.

2. A cylindrical classifier as in claim 1, further comprising a rotating means for rotating the cylinder about a horizontal axis.

3. A cylindrical classifier as in claim 1, further comprising a second cylinder disposed coaxially in surrounding relation about the first cylinder, the two cylinders being operatively connected together so as to be rotatable in synchrony.

4. A cylindrical classifier as in claim 3, wherein the cylinders are inclined with respect to the horizontal by about 1° to 15°.

5. A cylindrical classifier as in claim 4, wherein the coaxial separating cylinders are inclined with respect to the horizon by about 5°.

6. A cylindrical classifier as in claim 3, wherein the second cylinder has a surface defined by a screen material.

7. A cylindrical classifier as in claim 6, wherein the screen material of the second cylinder is round hole punch plate, the holes of which are of a size to prevent objects of a desired size from passing therethrough.

8. A cylindrical classifier as in claim 3, wherein the second cylinder is suspended about the axle by a plurality of support members.

9. A cylindrical classifier as in claim 3, wherein the second cylinder is disposed about the first cylinder so as to define therebetween a separator space.

10. A cylindrical classifier as in claim 9, wherein the members of the first cylinder are spaced from each other such that objects of a predetermined size pass therethrough into the separator space, and the screen of the second cylinder has a porosity so as to prevent objects of a predetermined size from passing therethrough.

11. A cylindrical classifier as in claim 10, wherein the members are spaced to define a gap of about 6 to 10 mm between each member.

12. A cylindrical classifier as in claim 11, wherein the cylinders of the classified are about 10 meters long.

13. A cylindrical classifier as claimed in claim 10, wherein the second cylinder has a surface defined by a screen material.

14. A cylindrical classifier as in claim 1, wherein at least one supplemental supporting ring is disposed between the ends of the first and second cylinder.

15. A cylindrical classifier as in claim 1, wherein the separator members are rods or tubes having a semicircular cross-section.

16. A cylindrical classifier as in claim 1, wherein the separator members have a smooth exterior surface.

17. A cylindrical classifier as in claim 1, wherein the separator members have a non-round exterior cross-section.

18. A cylindrical classifier as in claim 1, wherein the separator members have a roughly textured exterior surface.

19. A cylindrical classifier as in claim 1, wherein the separator members are formed so that each separator member has a preferred gravitationally induced orientation, so that as the cylinder is rotated about a horizontal axis, each separator member also rotates relative to the support ring.

20. A cylindrical classifier as in claim 19, wherein each separator member is unsymmetrically weighted relative to its longitudinal axis.

21. A cylindrical classifier for classifying objects by thickness comprising:

a first cylinder defined by a plurality of parallel separator members extending in a longitudinal direction from a first end of the cylinder to a second end of the cylinder, the parallel separator members being spaced apart so as to define gaps therebetween, a width of the gaps defining a separating parameter of the classifier; and at least two support rings, a first ring disposed near the first end of the cylinder, and a second ring disposed near the second end of the cylinder, the support rings being connected at a center thereof to an axle about which the rings are concentrically rotatable, the separator members being supported at each end of the cylinder by the support rings, whereby objects having a variety of thicknesses are infed to an interior of the first cylinder and are separated as objects having a thickness dimension less than the width of the gaps pass through the gaps and exit the cylinder while objects having a thickness greater than the width of the gaps do not pass through the gaps, wherein each support ring is suspended about the axle by a plurality of support members, and wherein the separator members are rotated relative to the support rings by a rotating means.

22. cylindrical classifier as in claim 21, wherein the rotating means is a motor which rotates each separator member.

23. A cylindrical classifier as claimed in claim 21, further comprising a second cylinder disposed coaxially in surrounding relation about the first cylinder, the two cylinders being operatively connected together so as to be rotatable in synchrony.

24. A cylindrical classifier as claimed in claim 23, wherein the second cylinder is disposed about the first cylinder so as to define therebetween a separator space.

* * * * *